US012723595B2

(12) United States Patent
Gashi et al.

(10) Patent No.: US 12,723,595 B2
(45) Date of Patent: Sep. 1, 2026

(54) METHOD FOR MACHINING RIBS OR GROOVES FOR AIR OR GAS BEARINGS OF A ROTARY-SHAFT-COMPRISING WORKPIECE OF A COMPRESSOR, AND METHOD FOR ASSEMBLING THE COMPONENTS OF THE WORKPIECE

(71) Applicant: The Swatch Group Research and Development Ltd, Marin (CH)

(72) Inventors: Rexhep Gashi, Givisiez (CH); Nicolas Chobaut, Bienne (CH); Patrick Wagner, Berne (CH); Vincent Pellerin, Châtillon (CH)

(73) Assignee: The Swatch Group Research and Development Ltd, Marin (CH)

( * ) Notice: Subject to any disclaimer, the term of this patent is extended or adjusted under 35 U.S.C. 154(b) by 88 days.

(21) Appl. No.: 18/643,465

(22) Filed: Apr. 23, 2024

(65) Prior Publication Data

US 2024/0369068 A1 Nov. 7, 2024

(30) Foreign Application Priority Data

May 4, 2023 (EP) ..... 23171496

(51) Int. Cl.
*F04D 29/42* (2006.01)
*F04D 17/12* (2006.01)
(Continued)

(52) U.S. Cl.
CPC ..... *F04D 29/4226* (2013.01); *F04D 17/12* (2013.01); *F04D 29/056* (2013.01); *F04D 29/284* (2013.01)

(58) Field of Classification Search
CPC ..... B23B 5/48; F16C 33/14; F16C 2220/60
See application file for complete search history.

(56) References Cited

U.S. PATENT DOCUMENTS 7,430,791 B2 * 10/2008 Yonemaru ..... B23B 5/48 29/27 C
7,640,833 B2 * 1/2010 Kimura ..... B23B 1/00 82/1.11
(Continued)

FOREIGN PATENT DOCUMENTS

EP 3557078 A1 10/2019
EP 4180154 A1 5/2023
(Continued)

OTHER PUBLICATIONS

European Search Report of No. 23171496 dated Oct. 20, 2023.

*Primary Examiner* — Michael W Hotchkiss
(74) *Attorney, Agent, or Firm* — Sughrue Mion, PLLC

(57) ABSTRACT

A method for machining ribs or grooves on a workpiece including a shaft (7) and an air or gas axial bearing (24) attached to the shaft or forming a part of the shaft. The workpiece is rotated about a longitudinal axis of a centrifugal compressor. All of the ribs or grooves are obtained at once by the machining tool on a workpiece portion driven such that it rotates, by moving the workpiece or the tool holder in a longitudinal direction, the machining tool moving back and forth with a machining position in contact with the workpiece and a position wherein it is not in contact with the workpiece from the beginning to the end of the workpiece portion. Reciprocating motions of the machining tool are synchronised with the sinusoidal program, as well as with the desired, programmed arrangement of the ribs or grooves to be produced on the workpiece portion.

10 Claims, 6 Drawing Sheets

(51) Int. Cl.
*F04D 29/056* (2006.01)
*F04D 29/28* (2006.01)

(56) References Cited

U.S. PATENT DOCUMENTS

| | | | | |
|---|---|---|---|---|
| 8,381,404 | B2 * | 2/2013 | Aoshima | F16C 17/026 384/100 |
| 2004/0179947 | A1 * | 9/2004 | Agrawal | F04D 25/0606 417/254 |
| 2011/0080673 | A1 * | 4/2011 | Aoshima | F16C 33/107 384/112 |
| 2013/0148918 | A1 * | 6/2013 | Aoshima | F16C 33/14 384/120 |
| 2013/0235489 | A1 * | 9/2013 | Aoshima | F16C 32/0666 384/123 |
| 2016/0047415 | A1 * | 2/2016 | Hunt | H01J 35/104 384/372 |
| 2019/0323509 | A1 * | 10/2019 | Gashi | F04D 17/122 |
| 2019/0323511 | A1 * | 10/2019 | Gashi | B60H 1/3223 |
| 2019/0323521 | A1 * | 10/2019 | Gashi | F04D 25/0606 |

FOREIGN PATENT DOCUMENTS

| | | | |
|---|---|---|---|
| JP | 11-19804 | A | 1/1999 |
| JP | 2002-036004 | A | 2/2002 |
| JP | 2013-185658 | A | 9/2013 |
| JP | 2019-190457 | A | 10/2019 |

* cited by examiner

METHOD FOR MACHINING RIBS OR GROOVES FOR AIR OR GAS BEARINGS OF A ROTARY-SHAFT-COMPRISING WORKPIECE OF A COMPRESSOR, AND METHOD FOR ASSEMBLING THE COMPONENTS OF THE WORKPIECE

CROSS REFERENCE TO RELATED APPLICATIONS

This application is claiming priority based on European Patent Application No. 23171496.5 filed on May 4, 2023.

FIELD OF THE INVENTION

The invention relates to a method for machining ribs or grooves for air or gas bearings of a rotary-shaft-comprising workpiece of a high-speed centrifugal fluid compressor, as well as to a method for assembling the components of the workpiece. The compressor is a two-stage compressor, and comprises a casing with a fluid inlet and a compressed fluid outlet and encloses a shaft rotatably mounted about a longitudinal axis. A first compressor wheel and a second compressor wheel are mounted back-to-back on the shaft, the first compressor wheel constituting a first compression stage and the second compressor wheel constituting a second compression stage. The centrifugal compressor further comprises a motor, preferably a synchronous electric motor, positioned between the first compressor wheel and the second compressor wheel and arranged to rotate the shaft. At least one air or gas axial bearing is mounted at one end of the shaft, and a front radial air or gas bearing is mounted on a first end of the shaft and a rear radial air or gas bearing is mounted on a second end of the shaft.

The invention further relates to the workpiece obtained by the method for machining and/or assembling the components of the workpiece.

BACKGROUND OF THE INVENTION

Fluid compressors are typically referred to as turbocompressors or centrifugal compressors. They comprise a stator and a rotor forming a permanent magnet synchronous motor (brushless motor). They can reach very high speeds, such as 100,000 to 500,000 rpm. The motor drives the compressor wheels at high speed, at which the compressor wheels compress the fluid. The fluid can be air, a gas, a refrigerant or any other suitable fluid. By using two compressor wheels, the fluid is compressed twice as much.

These compressors can be used, for example, in a mobile HVAC (heating, ventilation and air conditioning) system with a refrigerant gas, such as in electric, hybrid or hydrogen-powered vehicles. These compressors can also be used in a stationary system with a refrigerant gas, such as a heat pump.

These compressors typically comprise a first circuit for circulating the fluid to be compressed and a second circuit for circulating a cooling liquid used to cool the compressor, and more particularly the motor and the air or gas bearings supporting the motor shaft on the one hand, and the electronic components on the other. More specifically, rotating the motor at high speed causes it to heat up considerably, so much so that the compressor components need to be cooled to prevent damage thereto. These circuits are typically provided inside the compressor itself, at least as far as the cooling circuit is concerned. There is no provision to facilitate the flow of the cooling gas or air during the operation of the compressor, in particular at high speeds, which constitutes a drawback. Moreover, the air or gas bearings supporting the rotor shaft are not designed to support the rotor shaft without friction, which leads to significant heat generation when the rotor is rotating at a high speed, which constitutes another drawback.

Moreover, grooves or ribs are known to be made on the air or gas bearings for air or gas flow, and to create pressure and cooling. However, the grooves are produced without any specific arrangement by laser machining, which constitutes a drawback because the machining time is too long and thus the costs thereof are too high.

SUMMARY OF THE INVENTION

One purpose of the invention is to overcome the various drawbacks mentioned hereinabove by means of a method for rapidly producing grooves or ribs on a rotor shaft of a workpiece at each air or gas radial bearing, and on an air or gas axial bearing attached to the shaft or forming part of the shaft. Said grooves in the shaft are arranged in such a way as to overcome gravity when the shaft of the compressor rotates at high speed in each bearing and to allow the rotating rotor shaft to be held without mechanical contact on an air or gas current in the radial bearings and thus virtually frictionlessly.

To this end, the present invention relates to a method for machining ribs or grooves for air or gas bearings of a rotary-shaft-comprising workpiece of a high-speed fluid compressor, which comprises the features of independent claim 1.

Specific steps of the method are defined in dependent claims 2 to 8.

To this end, the present invention further relates to a method for machining ribs or grooves on a workpiece comprising a rotary shaft, as well as to a method for assembling the components of the workpiece according to independent claims 9 and 10.

To this end, the present invention further relates to a workpiece intended to be rotated about a longitudinal axis of a centrifugal compressor and intended to have ribs or grooves machined according to the machining method.

Specific embodiments of the workpiece are described herein.

One advantage of the method for machining ribs or grooves on a rotary-shaft-comprising workpiece of the compressor in a machining unit is that all the ribs or grooves are obtained at once on a workpiece portion driven in rotation, by a machining tool which moves back and forth from the beginning to the end of the workpiece portion of the rotary-shaft-comprising workpiece. To do this, the reciprocating motions of the machining tool are synchronised with the sinusoidal program set up in the machining unit, as well as with the desired arrangement of the ribs or grooves to be produced on the workpiece portion.

The sinusoidal function therefore makes it possible to achieve synchronisation between the rotation of the spindle or shaft and the movement in a longitudinal direction of the machining tool or spindle. The frequency and amplitude of the sinusoidal function are chosen as a function of the geometry of the grooves, the number of grooves, the speed of rotation of the shaft and the speed of the longitudinal displacement.

During the machining of the rotary-shaft-comprising workpiece, the workpiece or the tool holder carrying the machining tool is also displaced in a longitudinal machining direction while the machining tool carries out the reciprocating motions.

The reciprocating motions of the tool are compared to a piezoelectric oscillator where the oscillation frequency can be varied to speed up or slow down the reciprocating motions of the tool according to how the machining unit was programmed to obtain said desired ribs or grooves. During the reciprocating motions, the tool is in the machining position and in contact with the workpiece at one time and not in contact with the workpiece at another time.

The workpiece mainly comprises a shaft attached to a rotor structure of an electric motor driving it in rotation, or at least one air or gas axial bearing mounted at a first end of the shaft or forming a part of the shaft, between a compressor wheel and an air or gas radial bearing. Ribs or grooves can be produced on one face or preferably on both faces of the disc of the air or gas axial bearing. Alternatively, they can be produced on one face of the static axial bearings facing the axial disc.

One advantage of the method for machining ribs or grooves in a machining unit is that the ribs or grooves are produced very quickly in less than 1 minute on each workpiece portion of the shaft for the air or gas radial bearings and with great precision. The same applies to the grooves or ribs produced on one or both faces of the disc of the air or gas axial bearing driven rotatably. The machining tool is harder than the material of the shaft or of the air or gas axial bearing.

As explained above, the machining unit can be programmed for simultaneous synchronised rotation with the machining tool according to a sinusoidal program to obtain a rib or groove arrangement on each workpiece portion of the shaft for each air or gas radial bearing, and for the air or gas axial bearing.

As a result of such a machining of the ribs or grooves, which are preferably V-shaped with a change of orientation of each rib or groove in the centre of each machined portion on the shaft, the shaft rotating at high speed can be held in the compressor in the air or gas radial bearings without mechanical contact. The shaft is thus held in each radial bearing with virtually no friction by the pressure of the air or gas passing within the grooves or ribs as a result of the high-speed rotation of the shaft. From as low as 6,000 rpm, the air or gas pressure in each aerodynamic radial bearing is such that the shaft is no longer in mechanical contact with the static radial bearing, thus avoiding any mechanical friction. It goes without saying that the faster the shaft rotates, the greater the air pressure in the radial bearing, which automatically generates more air or gas friction.

The grooves or ribs are machined by the machining unit and the machining tool according to a sinusoidal program or function and the desired arrangement of the grooves or ribs, so as to reverse the orientation of the grooves or ribs on the shaft that is substantially towards the inner half of each static radial bearing placed above said ribs. This generates an air or gas pressure, which can become greater and greater the faster the shaft rotates.

Such a high-speed centrifugal fluid compressor can rotate at very high speeds without excessive heating due to the production of the ribs or grooves on the air or gas radial bearings.

A axial bearing is also provided between the first compressor wheel and the first radial bearing. Grooves or ribs are made at the periphery in the form of spirals on a front face and a rear face of the disc of the axial bearing. Films of air are generated by the grooves as the shaft rotates to hold the shaft in a longitudinally well-centred position.

BRIEF DESCRIPTION OF THE DRAWINGS

The purposes, advantages and features of the present invention will be better understood upon reading the following detailed description of one embodiment of the invention, which is given as a non-limiting example and illustrated in the accompanying drawings, in which.

DETAILED DESCRIPTION OF THE INVENTION

In the present description, all the components forming part of the centrifugal compressor, which are well known in the prior art, are only briefly described herein, as the invention essentially relates to the manner in which ribs or grooves are produced on two portions of a shaft in order to be covered by two static air or gas radial bearings respectively, or on an air or gas axial bearing.

Figure 1:
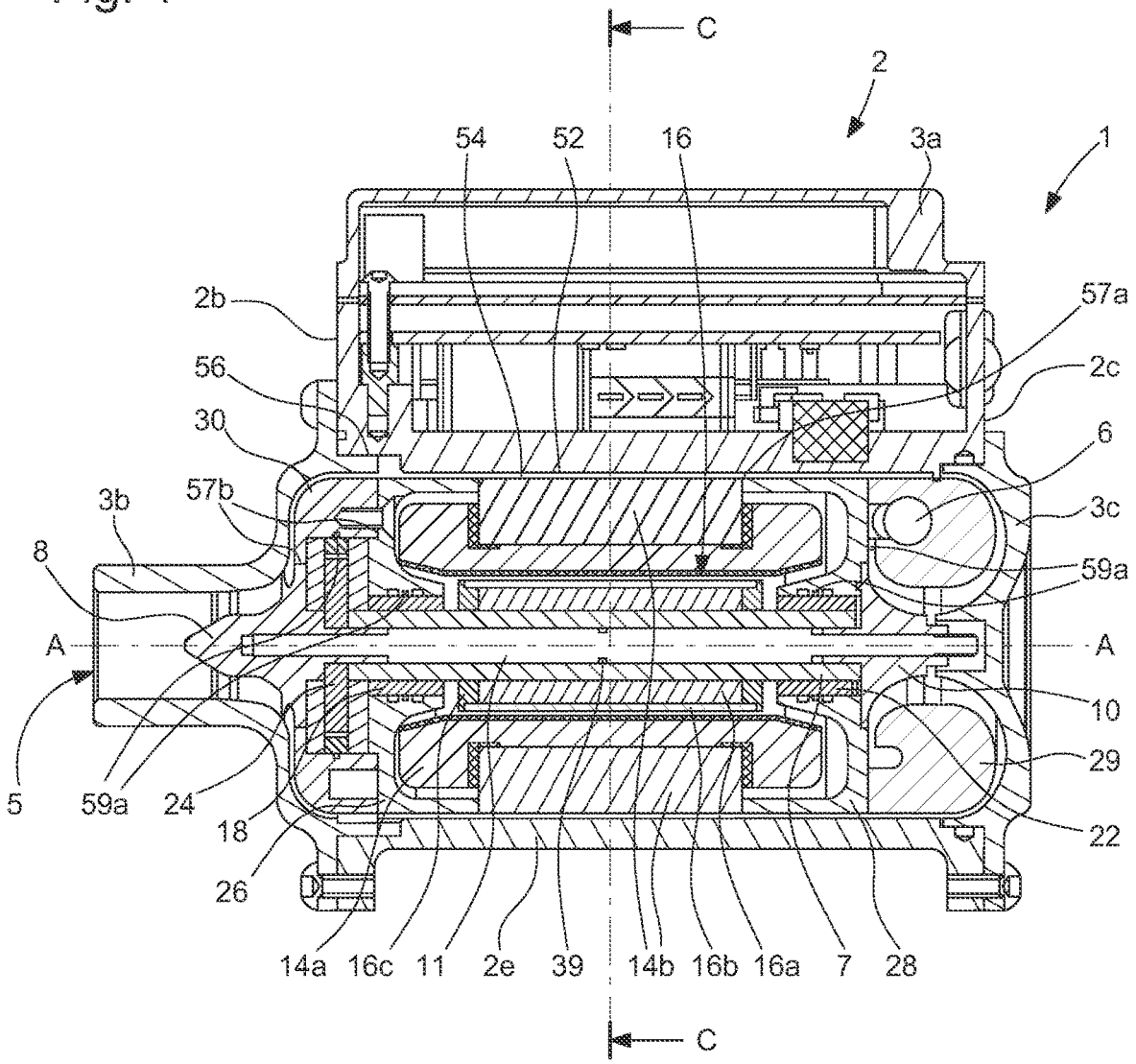
FIG. 1 shows a longitudinal sectional view, along the axis A-A, of a high-speed centrifugal compressor according to the invention.

FIG. 1 shows a cross-section, along the longitudinal axis A-A, of a high-speed centrifugal compressor 1. The centrifugal compressor comprises, in a casing 2, a shaft 7 made of tungsten carbide or ceramic, mounted such that it rotates about a longitudinal axis A-A passing through the front face 2*b* and rear face 20, a first centrifugal compressor wheel 8 and a second centrifugal compressor wheel 10 mounted back-to-back at each end of the shaft 7, said first compressor wheel 8 constituting a first compression stage and said second compressor wheel 10 constituting a second compression stage. In particular, the shaft 7 is hollow in this embodiment and encloses a threaded rod 11, to each end whereof one of the compressor wheels 8, 10 is screwed, enabling the compressor wheels to be easily mounted and removed. Thus, the two compressor wheels 8 and 10 are driven on the same shaft 7, which improves the energy efficiency and avoids the need for a gearbox. The rear of the compressor wheels 8 and 10 includes a labyrinth seal to control the pressures in the compressor and balance the axial forces.

The casing 2 further encloses an electric motor that is preferably synchronous, positioned between the first compressor wheel 8 and the second compressor wheel 10 and arranged to rotate the shaft 7. The motor comprises a stator 14 and a rotor structure 16 which interact with one another to form a synchronous electric motor with at least one permanent magnet 16*a* (brushless motor). More particularly, the stator 14 is formed by a coil 14*a* and two ferrite elements 14*b*, mounted such that they are fixed relative to the casing 2. The rotor structure 16 comprises one or more permanent magnets 16*a* made integral with the shaft 7, for example by bonding, and is covered by a lining 16*b*. Flanges 16*c* are attached (for example by bonding) to the lateral ends of the lining and ensure that the magnet is resistant to the centrifugal forces at high speeds.

Figure 2A:
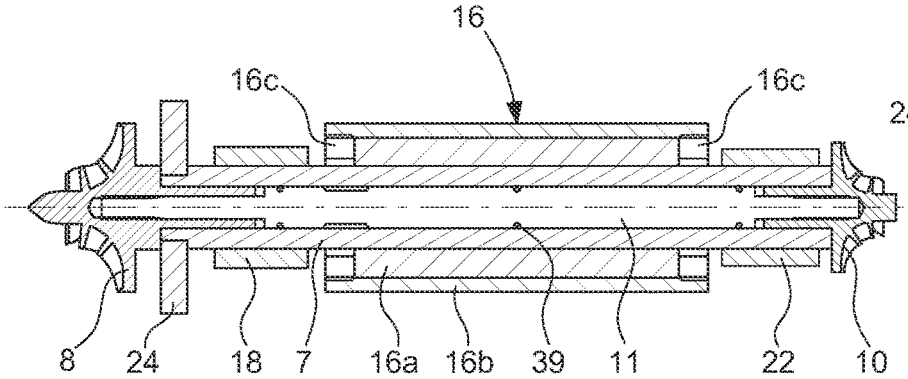
FIGS. 2*a* and 2*b* show a longitudinal sectional view, along the axis A-A, of the shaft with the compressor wheels, the aerodynamic axial and radial bearings and the rotor structure that has one or more permanent magnets according to the invention, and a plan view from the side of the first compressor wheel and the axial bearing according to the invention.

It should be noted that the workpiece intended to be rotated about a longitudinal axis A-A of a centrifugal compressor comprises at least one shaft 7, on which or in which a rotor structure 16 with at least one permanent magnet 16*a* of an electric motor is mounted or attached in order to drive the shaft such that it rotates about the longitudinal axis A-A, and an air or gas axial bearing 24 attached to one end of the shaft 7 or forming a part of the shaft 7. The workpiece can further comprise a first compressor wheel 8 and a second compressor wheel 10 mounted at two ends of the shaft 7, a front air or gas radial bearing 18 mounted on a first end of the shaft 7, and a rear air or gas radial bearing 22 mounted on a second end of the shaft 7, as shown in FIG. 2*a*.

As described below with reference to FIGS. 10 and 12, the machining method is carried out in a machining unit 100 which is adapted to receive the workpiece and in particular the shaft 7 with the axial bearing 24, and comprises a tool holder 110 with a tool for machining the ribs or grooves on at least a portion of the shaft 7 of the workpiece.

The shaft 7 is mounted such that it can rotate in the casing 2 about the longitudinal axis A-A thereof by means of at least one front radial bearing 18, one rear radial bearing 22 and one axial bearing 24. The centrifugal compressor 1 comprises a front radial bearing support 26 for carrying the front radial bearing 18, and a rear radial bearing support 28 for carrying the rear radial bearing 22, arranged to be positioned around the shaft 7, respectively at the front and rear of the motor. At the rear, a volute 29 is also provided between the rear radial bearing support 28 and the rear cover 3*c*. The volute 29 comprises the orifice leading to the tangential fluid outlet 6, after compression. An axial bearing support 30 is also provided to carry the axial bearing 24, arranged to be positioned around the shaft 7, between the first compressor wheel 8 and the front radial bearing support 26. It is clear that the axial bearing could be provided at the rear of the motor.

The bearings are non-contact, aerodynamic type bearings, in order to generate little friction. They require no lubrication and very little maintenance. More particularly, with reference to FIGS. 2*a*, 2*b* and 4, the axial bearing 24 is an aerodynamic bearing and is constituted by a disc including, on at least one of the faces thereof, first grooves 24*a*, preferably spiral-shaped over an annular area at the periphery, arranged to create a film of air. Preferably, the axial bearing 24 comprises preferably spiral-shaped grooves or ribs 24*a* at the periphery of the disc of the axial bearing 24 on a front face and on a rear face, obtained by a machining process explained below. The orientation of the grooves or ribs 24*a* can be different on the front face to that on the rear face or can be identical. The axial bearing 24 with its grooves or ribs 24*a* keeps the rotating shaft 7 longitudinally centred by generating films of air from the front face and rear face. The front radial bearing 18 and the rear radial bearing 22 are aerodynamic bearings, and the shaft 7 has, facing the front 18 and rear 22 radial bearings, second grooves or ribs 32 arranged to create a film of air or gas when the shaft is rotated in the air or gas radial bearings.

Figure 2B:
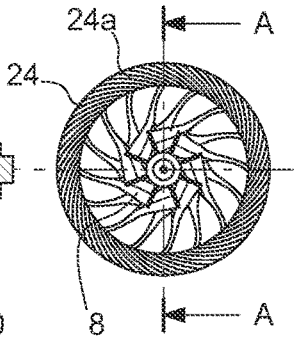
Figure 4:
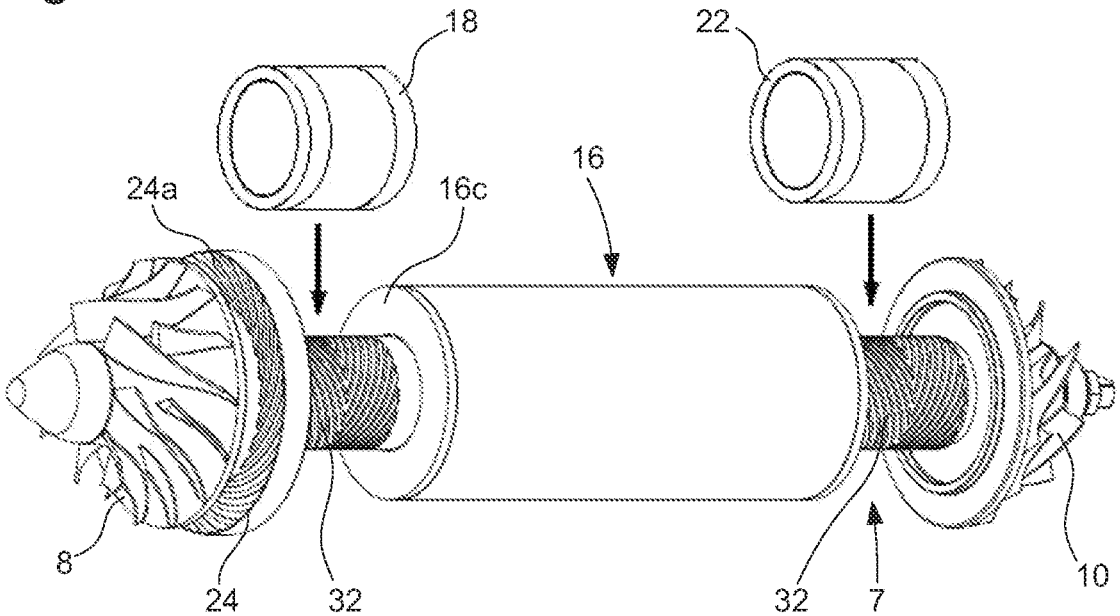
FIG. 4 is a three-dimensional view of the assembly in FIGS. 2*a* and 2*b* showing the grooves or ribs in each static radial bearing shown raised above the shaft according to the invention.

In FIGS. 2*a*, 2*b* and 4, the first centrifugal compressor wheel 8 and the second centrifugal compressor wheel 10 can still be seen mounted back-to-back at each end of the shaft 7. At the two ends of the shaft 7, there is a first portion of machined ribs or grooves 32 and at the other end a second portion of machined ribs or grooves 32. The rotor structure 16 with at least one permanent magnet 16*a* is fixed on the shaft in a central position for the electric motor.

It is also possible to have a rotor structure 16, which comprises one or more diametrically magnetised permanent magnets 16*a* bonded, shrunk inside the shaft 7 or disposed in a lining 16*b*. The one or more permanent magnets 16*a* can be shrunk into the lining 16*b* with as much rigidity and interference as possible to compress each magnet in order to compensate for the orthoradial pull resulting from centrifugal forces.

It should also be noted that the clearance between the shaft 7 and the one or more magnets 16*a* mounted on the outside of the shaft 7 must be sufficient to prevent any clamping of the magnet 16*a* against the shaft 7 at high speed and high temperature, which would put the inside of the magnet 16*a* in a state of high bi-axial tension and thus increase its risk of breaking. More specifically, the radial displacement of the inner surface of each magnet 16*a* can be less than the radial displacement of the outer surface of the shaft 7 due to the negative thermal expansion coefficient of the magnet in a radial direction. This is illustrated by the hatched area in FIG. 3, where the inner surface of the magnet 16*a* approaches the outer surface of the shaft 7 at the end of the rapid deceleration of the rotor structure 16 when it is still hot.

Figure 3:
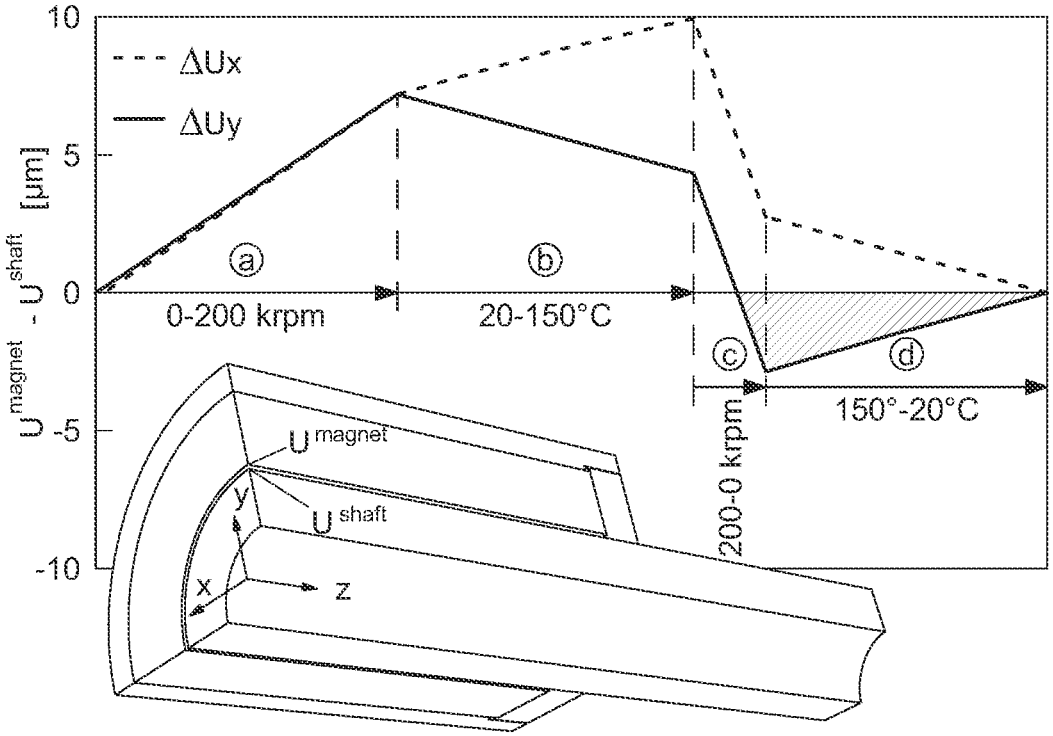
FIG. 3 shows a graph of the difference between a radial displacement of the outer surface of the shaft and that of the inner surface of the one or more permanent magnets according to the invention.

FIG. 3 gives a graph showing the difference between a radial displacement of the outer surface of the shaft 7 and that of the inner surface of the one or more permanent magnets 16*a* according to the invention. x corresponds to the direction of diametrical magnetisation of the magnet and y corresponds to the orthogonal direction in which the magnet contracts radially during heating. In the case of mounting by bonding, this difference corresponds to the radial deformation to be elastically accommodated by the adhesive between the shaft 7 and the permanent magnet 16*a*.

A bond can be formed between the shaft 7 and the magnet 16*a*, if the adhesive can withstand the radial deformation (up to 10 μm seen in FIG. 3) under tensile stress at high temperature and at high speed. In this case, if the adhesive warps at operating temperature (for example at 150° C.) or if its modulus of elasticity decreases by several orders of magnitude, it no longer fulfils its load-bearing role and thus becomes useless.

In FIGS. 2*a* and 4, flanges 16*c* are attached to the lateral ends of the lining 16*b* in order to guarantee the mechanical integrity of the magnet 16*a* or of a plurality of magnets 16*a* in parallel side by side on the shaft 7 and that are subjected to centrifugal forces. The flanges 16*c* can be bonded or shrunk between the shaft 7 and the lining 16*b*.

Adhesive-free assembly is achieved by optimising the shrink fit (choice of materials and interference) of the flanges 16*c* on the shaft 7, the flanges 16*c* in the lining 16*b* and the lining 16*b* on the magnet 16*a*. Torque is thus transmitted from the magnet 16*a* or each magnet 16*a* to the shaft 7 via the flanges 16*c*. An adhesive-free assembly guarantees better rigidity than adhesive bonding, particularly at high speed and temperature where an assembly produced through adhesive bonding would see the frequency of its first bending mode decrease dangerously towards the rotation frequency.

The lining 16*b* or casing can ideally be made of carbon fibre and alternatively of a titanium or molybdenum alloy. The flanges 16*c* are ideally made of titanium alloy and alternatively of non-magnetic steel. The diametrical interference of the flanges 16*c* in the lining 16*b* is ideally the same as or slightly less than that of the lining 16*b* on the one or more magnets 16*a*.

It should also be noted that if the lining 16*b* and the flanges 16*c* are made of the same material, the lining 16*b* can be combined with at least one of the two flanges 16*c* to form a single part, particularly for mounting the permanent magnet structure 16*a* on an external side of the shaft 7. A flange 16*c* can also be replaced with a shoulder made on the shaft 7 (shrink fit banking for the flange, and axial positioning of the magnet).

As explained below, in particular in FIG. 10, although the grooves or ribs obtained by turning the shaft can be produced on the shaft in the bare state, it is nevertheless preferable to produce them after the assembly consisting of the lining 16*b*, the permanent magnet 16*a* and the flanges 16*c* has been mounted on the shaft 7 in order to guarantee the best geometric tolerances for the two aerodynamic bearings 18 and 22 shown in cross-section in FIG. 2*a*.

Although the grooves or ribs obtained by laser ablation on the shaft can be produced before or after the assembly consisting of the lining 16*b*, the permanent magnet 16*a* and the flanges 16*c* has been mounted on the shaft 7, it is preferable to produce these grooves or ribs after the axial disc 24 has been shrunk onto the shaft 7 if the magnet 16*a* is inside the shaft 7. In any case, it is essential that the final geometry of the bearings (and optionally of the assembly with the axial disc if assembled before finishing) is obtained before laser ablation.

Although the magnet 16*a* can be magnetised before it is mounted on the shaft 7, it is preferable to magnetize it after mounting, measuring and balancing the rotor structure 16 in order to facilitate these steps.

Figure 5:
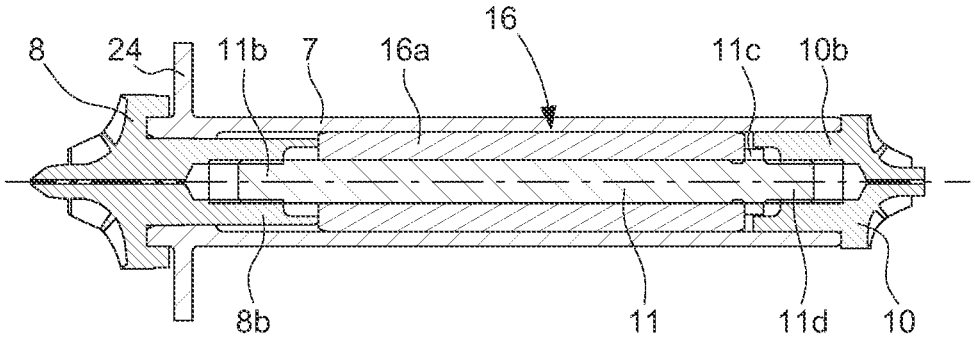
FIG. 5 shows a first alternative embodiment of a longitudinal sectional view, along the axis A-A, of the shaft with the compressor wheels, at least the axial bearing integral with the shaft and the rotor structure with one or more permanent magnets according to the invention disposed inside the shaft.

A first alternative embodiment is shown in FIG. 5 by way of a longitudinal sectional view, along the axis A-A, of the shaft 7 with the compressor wheels 8 and 10, at least the axial bearing 24 integral with the shaft 7 and the rotor structure 16 with one or more permanent magnets 16*a* according to the invention disposed inside the shaft 7, which is in tubular form. In this case, the one or more permanent magnets 16*a* are shrunk inside the shaft 7 or mounted with a small radial clearance. It should also be noted that the clearance between the rod 11 and the one or more magnets 16*a* mounted inside the shaft 7 must be sufficient to prevent the magnet 16*a* from being clamped against the rod 11 at high speed and high temperature, which would place the inside of the magnet 16*a* in a state of high bi-axial tension and thus increase its risk of breaking. The rod is threaded at its two ends 11*b* and 11*d* so that it can be screwed firstly into an internal thread 8*b* of the first compressor wheel 8, and secondly into an internal thread 10*b* of the second compressor wheel 10. The shoulder 11*c* is provided in the case of radial play between the shaft 7 and the magnet 16*a* in order to axially secure the magnet 16*a* and the threaded rod 11 after the compressor wheel 8 has been screwed on. By tightening the compressor wheel 10, the threaded rod 11 and the shaft 7 are axially secured to one another.

When the magnet 16*a* is inside the shaft 7 and the material of the shaft 7 is too fragile to allow shrink-fitting, the magnet 16*a* is secured to the shaft 7 either by bonding or by axial clamping via a rod placed under tensile stress. Axial clamping can also be produced on a solid magnet by machining threads directly in the shaft in order to screw in the wheels which will hold the magnet in the hollow shaft 7.

The hollow magnet is thus axially compressed slightly between the shoulder of the rod 11*b* and the tubular end 8*b* of the wheel 8. Tightening the wheel 8 compensates for the thermal expansion mismatch between the rod 11 and the magnet 16*a*. Tightening the wheel 10 compensates for the thermal expansion mismatch between the rod 11 and the shaft 7 and maintains sufficient adhesion to transmit torque.

Figure 6:
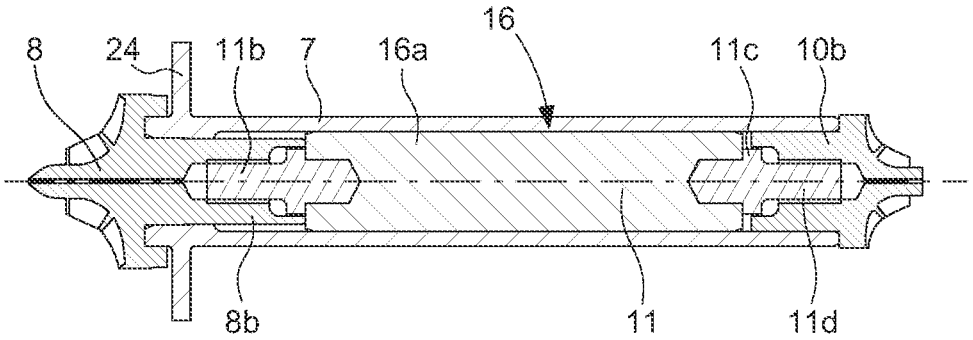
FIG. 6 shows a second alternative embodiment of a longitudinal sectional view, along the axis A-A, of the shaft with the compressor wheels, at least the axial bearing integral with the shaft and the rotor structure with one or more permanent magnets according to the invention disposed inside the shaft.

FIG. 6 shows a second alternative embodiment of a longitudinal sectional view, along the axis A-A, of the shaft 7 with the compressor wheels 8 and 10, at least the axial bearing 24 integral with the shaft 7 and the rotor structure 16 with one or more permanent magnets 16*a* disposed inside the hollow shaft 7. This alternative embodiment combines bonding and axial clamping for assembling the almost solid magnet 16*a* inside the shaft 7. To do this, rods 11*b* and 11*d*, threaded at one end only and provided with shoulders at the other end, are bonded on their smooth part in the almost solid magnet 16*a* and screwed on the other side into the wheels. As a result, the magnet undergoes axial traction to ensure that the wheels are preloaded on the shaft 7 to allow torque to be transmitted by adhesion.

Figure 7:
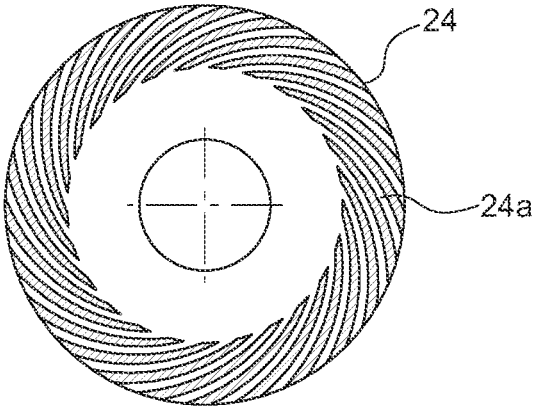
FIG. 7 is a plan view of the air or gas axial bearing.

FIG. 7 shows an embodiment of the air or gas axial bearing 24. As can be seen in this FIG. 7 in plan view, ribs or grooves 24*a* of a certain depth are produced on an annular area starting from the periphery of the disc and leading towards the centre of the disc. The ribs or grooves 24*a* and the arrangement thereof are programmed, in particular in the machining unit, to activate the machining tool so as to produce all of the ribs or grooves at once, i.e. by moving the tool holder, or the rotating disc in a single machining direction, for example from the periphery of the disc to the bottom of the annular area of the ribs or grooves. Starting, for example, from the periphery of the disc on one face, groove portions are gradually formed by reciprocating motions of the machining tool in synchronism with the machining unit rotating the disc at a given speed according to a sinusoidal program or function.

With this program and in combination with the controlled reciprocating motions of the machining tool, each start of all of the grooves 24*a* is achieved by the rotation of the disc and the reciprocating motions of the machining tool. This is continuously repeated for the following groove or rib portions continuously from the first groove portion to the end or to the bottom of the annular area. With such a way of producing the different ribs or grooves 24*a* on the disc 24, the machining time per grooved face of the disc is less than one minute, which is significantly different from a previous machining technique using a laser beam.

Figure 8:
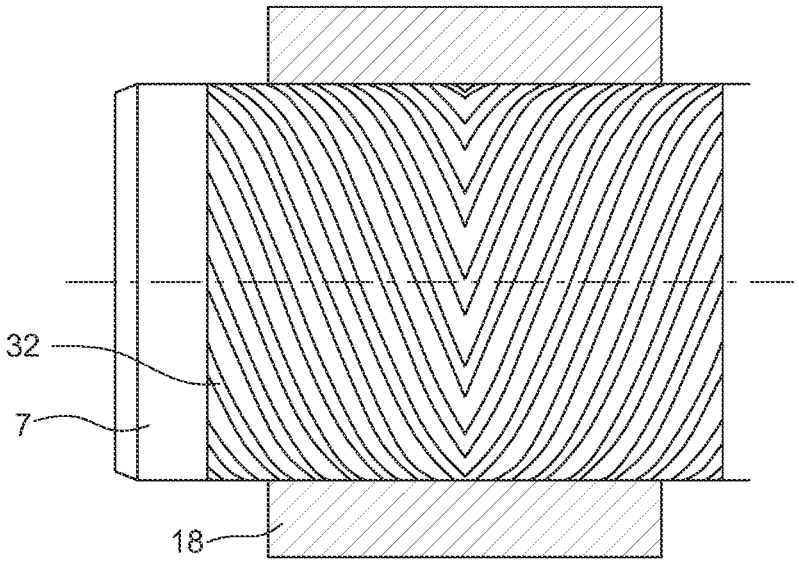
FIG. 8 is a view of the ribs or grooves disposed at one end of the shaft on which is disposed the static radial bearing shown via a longitudinal section according to the invention.

FIG. 8 shows a first portion of ribs or grooves 32 produced on a first end of the shaft 7 with a first air or gas radial bearing 18 shown via a longitudinal section on the first portion of ribs or grooves 32 produced by the machining method.

As with the production of the grooves or ribs on the axial disc described hereinabove, during the machining of these grooves or ribs 32, the shaft 7 is rotated by the machining unit about the longitudinal axis thereof and moved along the longitudinal axis thereof in a machining direction. The machining tool disposed in its tool holder is moved back-and-forth opposite the first portion of the shaft to be machined at a frequency that depends on how the machining unit was programmed. It should be noted that instead of moving the shaft 7 in a longitudinal direction, the tool holder could be moved in the longitudinal machining direction. All of the ribs or grooves 32 are obtained at once by the machining tool on the first workpiece portion of the first end of the shaft driven in rotation, said machining tool carrying out reciprocating motions from the beginning to the end of the first workpiece portion of the shaft 7.

The machining unit is programmed to have a simultaneous synchronised rotation of the shaft 7 with the machining tool according to a sinusoidal program to obtain a determined arrangement of the ribs or grooves 32 on the first workpiece portion of the shaft 7 for the front air or gas radial bearing 18. Starting, for example, from the start of the first workpiece portion of the shaft 7 on the same side as the first end thereof and in one machining direction only, and as far as the end of the first portion of the first end of the shaft 7, all of the ribs or grooves 32 are machined at once, which significantly reduces the machining time.

It can therefore be determined that the sinusoidal function does indeed achieve synchronisation between the rotation of the shaft 7 and the displacement in a longitudinal direction of the machining tool or of the shaft 7. The frequency and amplitude of the sinusoidal function are chosen as a function of the geometry of the grooves 32, the number of grooves 32, the speed of rotation of the shaft and the speed of the longitudinal displacement.

The specific arrangement of the ribs or grooves 32 produced on the first portion of the first end of the shaft 7 is programmed in the machining unit. In one desired embodiment, the ribs or grooves 32 are each V-shaped, i.e. they include a change of orientation in principle from the middle of the first workpiece portion of the shaft 7. This ensures that the shaft rotating at high speed in the compressor is held without mechanical contact in the air or gas journal bearings. From as low as 6,000 rpm, the air or gas pressure in each aerodynamic radial bearing is such that the shaft is no longer in mechanical contact with the static journal bearing, thus avoiding any mechanical friction.

Figure 9:
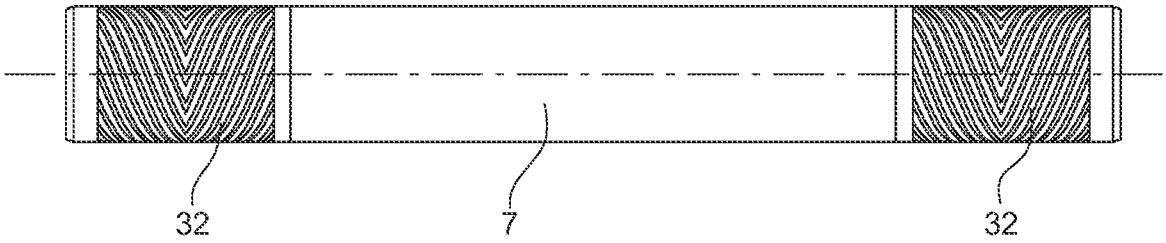
FIG. 9 is a view of the shaft with grooves or ribs disposed at the two ends of the shaft and on which are respectively disposed the static air or gas radial bearings according to the invention.

FIG. 9 shows the shaft 7 with a first portion containing machined ribs or grooves 32 on the first end of the shaft and a second portion on the second end of the shaft 7. The first portion and the second portion are machined in the same way as described above with reference to FIG. 6. The same arrangement of V-shaped ribs or grooves 32 at the two ends of the shaft 7 can be provided.

As a supplement to FIG. 1, the compressor 1 comprises a casing 2, made of aluminium, the top face 2*a* whereof is closed by a top cover 3*a* and the front face 2*b* and rear face 2*c* whereof are closed by a front cover 3*b* and a rear cover 3*c* respectively. The side faces 2*d* of the casing are joined at their base to form a bottom 2*e* with a U-shaped cross-section.

The top cover 3*a* is positioned on the same side as the electronic components of the compressor. Thus, access to the electronic components integrated in the compressor is easy, which access is provided through the top cover 3*a*. The front and rear covers 3*b*, 3*c* are used to reach the interior of the compressor (motor, rotor, bearings, etc.). A gasket is interposed between the top face of the casing 2 and the top cover 3*a*. This gasket protects the electronic components from dust and moisture.

The casing 2 has an inlet 5 for the fluid to be compressed provided on the front cover 3*b* and a tangential outlet 6 for the compressed fluid provided on one of the side faces of the casing 2.

In FIG. 1, the casing 2 comprises an inner housing extending coaxially to the longitudinal axis A-A from end to end between the front face 2*b* and the rear face 2*c* of the casing 2 and receiving the front radial bearing support 26 and the front radial bearing 18, the motor and the rotor structure 16 thereof attached to the shaft 7, the rear radial bearing support 28 and the rear radial bearing 22, the second compressor wheel 10 and the volute 29. On the front face 2*b* side, the inner housing is closed by the front cover 3*b* which integrates the first compressor wheel 8, the axial bearing support 30 and the axial bearing 24. On the rear face 2*c* side, the inner housing is closed by the rear cover 3*c*.

Moreover, at least one orifice is advantageously provided, for example the point given the reference 57*a*, arranged to allow the fluid to be compressed circulating within the channels to enter the motor and circulate between the stator 14 and the rotor structure 16, and at least one orifice, for example the points given the reference 57*b*, arranged to allow the fluid to be compressed to exit the motor and rejoin said channels after having cooled the motor.

Similarly, at least one orifice is advantageously provided, for example the points given the reference 59*a* in FIG. 1, arranged to allow the fluid to be compressed circulating within the channels 54 to circulate in the vicinity of the axial bearing 24, the front radial bearing 18 and the rear radial bearing 22, and at least one orifice corresponding, for example, to the same points given the reference 57*b*, arranged to allow the fluid to be compressed to rejoin said channels 54 after having cooled said axial bearing 24, front radial bearing 18 and rear radial bearing 22.

Thus, after entering the first compression stage through the inlet 5, the fluid to be compressed passes in the channels 54 through the parts of the compressor located along the longitudinal axis between the first compression stage and the second compression stage to rejoin the second compression stage. As a result, the fluid to be compressed, as it passes between the inner wall 52 and the ferrite elements 14*b* of the motor, cools the latter and recovers lost heat from the motor to increase the efficiency thereof before entering the second compression stage. Moreover, the orifices 57*a*, 57*b*, 59*a* allow for a slight deviation of the flow so that the fluid to be compressed also circulates between the stator 14 and the rotor structure 16 and in the bearings in order to cool these elements and recover the heat losses from the motor and the heat losses due to friction in the bearings.

The centrifugal compressor 1 allows very high rotational speeds to be reached, lying in the range 100,000 rpm to 500,000 rpm. It allows the fluid compressed in the first compression stage to pass substantially through the entire system to recover any waste heat, and in particular waste heat from the motor, bearings and electronic components, in order to increase the efficiency thereof before entering the second compression stage (as the temperature of the fluid to be compressed increases, so does the pressure thereof). Moreover, the use of the only fluid to be compressed to cool the compressor, without the aid of an additional cooling circuit, as well as the arrangement of the electronic components in the compressor for the electronics to be integrated into the casing, results in a very compact compressor. The compressor according to the invention thus has a high rotational speed and a high compression ratio while occupying a small volume. For example, a compressor according to the invention has a compression ratio greater than 3, and a power of the order of 4 kW for dimensions L×W×H in cm of the order of 14×8×11 for a weight of only 1.6 kg.

For example, the compressor according to the invention can be used with air or gas to power fuel cells, or any other system that uses compressed air (industrial compressors, medical compressors, ships, etc.).

With a refrigerant gas, the compressor according to the invention can be used in a mobile HVAC (heating, ventilation and air conditioning) system, such as in electric, hybrid or hydrogen vehicles.

The centrifugal compressor can also be used in a stationary system with a refrigerant gas such as a heat pump.

The centrifugal compressor can also be used with a natural gas.

Figure 10:
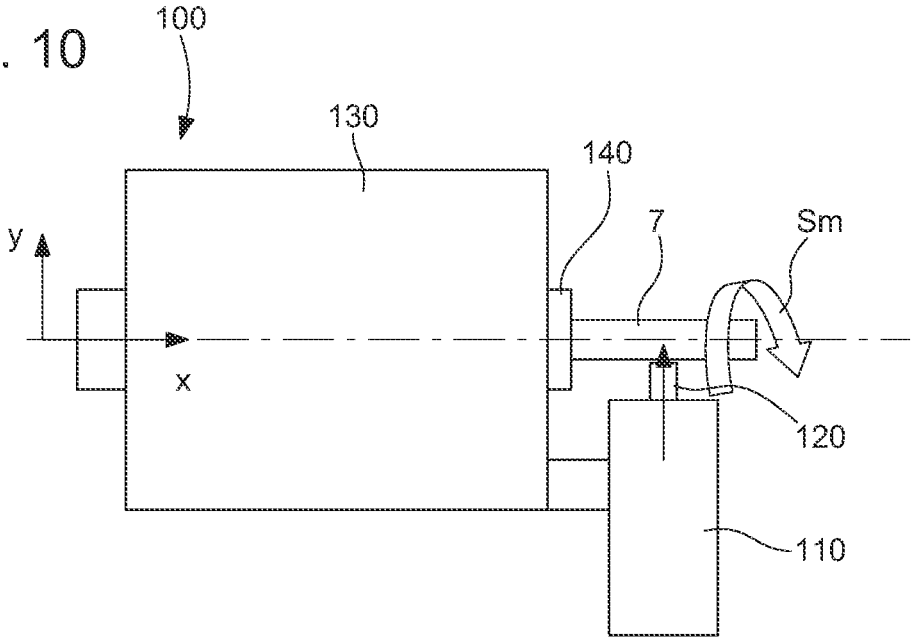
FIG. 10 is an overview of a machining unit for machining the grooves or ribs on the shaft of the centrifugal compressor according to the invention.

FIG. 10 shows an overview of the machining unit 100 for producing ribs or grooves on portions of the first end and the second end of the shaft 7.

The machining unit 100 comprises a lathe 130 with a spindle 140 for holding the shaft 7 and rotating it when machining the ribs or grooves. According to an alternative embodiment, the spindle that holds the shaft in rotation can move in a longitudinal machining direction to produce the ribs or grooves as shown by the arrow Sm.

The machining unit 100 further comprises a tool holder 110 connected to the structure of the lathe 130. The tool holder 110 carries a machining tool 120, the machining head whereof, which comes into contact with the shaft to machine the grooves or ribs, can be moved back and forth according to how the machining unit is programmed. The head of the machining tool 120 can be made of diamond for machining the ribs or grooves on the shaft 7 made of tungsten carbide or ceramic. This is carried out so as to have a simultaneous synchronised rotation of the shaft 7 with the machining tool according to a sinusoidal program to obtain a determined arrangement of the ribs or grooves on the workpiece portions of the shaft 7 for each front or rear air or gas journal bearing.

In an alternative embodiment, the tool holder 110 can also be moved in a longitudinal machining direction instead of the shaft 7 for machining the ribs or grooves on the shaft.

The frequency of the reciprocating motions of the tool can also be changed according to how the machining unit 100 is programmed.

Figure 11:
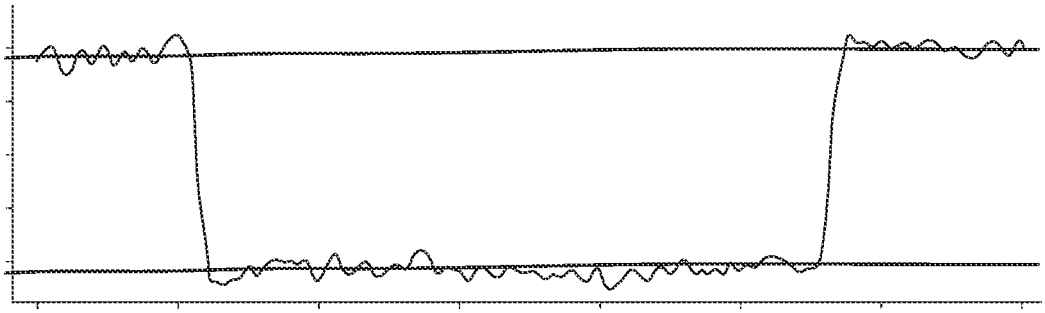
FIG. 11 is a graph of a precision rib produced on the shaft for the air or gas radial bearings according to the invention.

FIG. 11 shows a precision rib or groove for air or gas bearings obtained by the reciprocating motions of the machining tool, which is determined by the material to be machined, the speed of rotation of the shaft for the machining operation, the diameter of the shaft and many other parameters.

Figure 12:
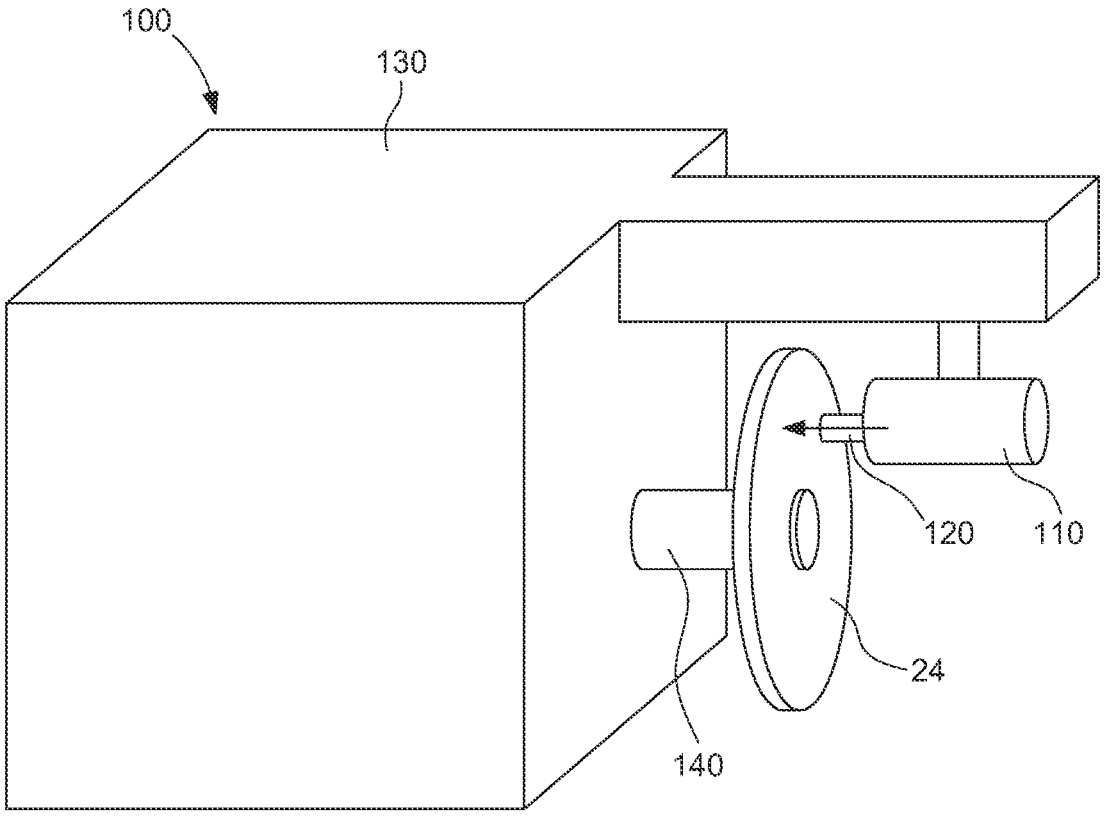
FIG. 12 is a three-dimensional overview of a machining unit for machining the grooves or ribs on an air or gas axial bearing of the centrifugal compressor according to the invention.

Finally, FIG. 12 shows a machining unit 100 for producing ribs or grooves on one or two faces of the disc of the air or gas axial bearing 24. This machining unit 100 comprises the same elements as those described with reference to FIG. 10 and will not be repeated with reference to this FIG. 12. Only the manner in which the tool holder 110 is connected to the structure of the lathe 130 should be noted.

It goes without saying that the present invention is not limited to the examples shown and that various alternatives and modifications that may be clearly apparent to a person skilled in the art can be made thereto. Other combinations are of course possible with what is already known with centrifugal compressors. Fast and precise machining of ribs or grooves can be carried out on other workpieces than those described hereinabove with equivalent machining elements.

The invention claimed is:

1. A method for machining ribs or grooves on a workpiece intended to be rotated about a longitudinal axis (A-A) of a centrifugal compressor (1), the workpiece comprising a shaft (7), on which or in which a rotor structure (16) with at least one permanent magnet (16*a*) of an electric motor is mounted or attached in order to drive the shaft such that it rotates, and/or an air or gas axial bearing (24) attached to one end of the shaft (7) or forming a part of the shaft (7), the centrifugal compressor (1) further comprising a casing (2) with a fluid inlet (5) and a compressed fluid outlet (6), a first compressor wheel (8) of the workpiece and a second compressor wheel (10) of the workpiece mounted at two ends of the shaft (7) in the casing (2), a front air or gas radial bearing (18) mounted on a first end of the shaft (7), and a rear air or gas radial bearing (22) mounted on a second end of the shaft (7), the machining method being carried out in a machining unit (100) adapted to receive the workpiece and comprising a tool holder (110) with a machining tool for machining the ribs or grooves on at least one portion of the workpiece, wherein all of the ribs or grooves (24*a*; 32) are obtained at once by the machining tool on a workpiece portion of the shaft (7) rotatably driven, by moving the shaft (7) of the workpiece or the tool holder (110) in a longitudinal machining direction, said machining tool moving back and forth with a machining position in contact with the workpiece and a position wherein it is not in contact with the workpiece from a beginning to an end of the workpiece portion, wherein reciprocating motions of the machining tool are synchronised with a sinusoidal program set up in the machining unit, as well as with a desired, programmed arrangement of the ribs or grooves to be produced on the workpiece portion, wherein all of the ribs or grooves (32) are obtained at once on a first workpiece portion of the first end of the shaft (7) from the beginning of the first portion to the end of the first portion, by the reciprocating motions of the machining tool and a displacement in a longitudinal machining direction of the rotating shaft (7) according to how the machining unit (100) was programmed, and wherein all of the ribs or grooves (32) are obtained at once on a second workpiece portion of the second end of the shaft (7) from the beginning of the second portion to the end of the second portion, by the reciprocating motions of the machining tool and the displacement in a longitudinal machining direction of the rotating shaft (7) or tool holder (110).

2. A method for machining the ribs or grooves on a workpiece (7, 24) according to claim 1, and for assembling the components of the workpiece, said components being the shaft (7) on which is attached the air or gas axial bearing (24) in the form of a disc attached to one end of the shaft (7), and on which or in which the rotor structure (16), having at least one permanent magnet (16*a*), of the electric motor is disposed or attached between the first and second portions of the shaft (7), wherein all of the ribs or grooves (24*a*) on one face or two faces of the disc are machined after the machining of the ribs or grooves on the first portion and/or the second portion of the shaft (7) and before the placing or attachment of the rotor structure (16) having at least one permanent magnet (16*a*) on or in the shaft between the first portion and the second portion, which are machined from the shaft (7).

3. The method for machining the ribs or grooves on a workpiece (7, 24) according to claim 1, and for assembling the components of the workpiece, said components being the shaft (7) on which is attached the air or gas axial bearing (24) in the form of a disc attached to one end of the shaft (7), and on which or in which the rotor structure (16), having at least one permanent magnet (16*a*), of the electric motor is disposed or attached between the first and second portions of the shaft (7), wherein the rotor structure (16), having at least one permanent magnet (16*a*), of the electric motor is disposed or attached between the first and second portions of the shaft (7) before the ribs or grooves are machined on the first portion and the second portion of the shaft (7), and wherein all of the ribs or grooves (24*a*) on one face or two faces of the disc are machined after the machining of the ribs or grooves on the first portion and/or the second portion of the shaft (7).

4. The machining method according to claim 1, wherein the workpiece is the shaft (7), which is made of tungsten carbide or ceramic, and wherein a head of the machining tool (120) is made of diamond for machining the ribs or grooves on a first machined portion and on a second machined portion of the rotating shaft (7).

5. The machining method according to claim 4, wherein during the machining of the ribs or grooves (32), a change of orientation of the ribs or grooves (32) occurs when passing a halfway point along the first workpiece portion of the first end of the shaft (7) according to how the machining unit was programmed so as to obtain V-shaped grooves over a length of the first machined portion in order to generate an air or gas pressure in a front radial bearing (18) disposed on the first portion during operation of the compressor with the rotation of the shaft (7) above a limit speed so as to no longer have any mechanical contact with the front radial bearing (18).

6. The machining method according to claim 4, wherein during the machining of the ribs or grooves (32), a change of orientation of the ribs or grooves (32) occurs when passing a halfway point along the second workpiece portion of the second end of the shaft (7) according to how the machining unit (100) was programmed so as to obtain V-shaped grooves over a length of the second machined portion in order to generate an air or gas pressure in a rear radial bearing (22) disposed on the second portion during operation of the compressor (1) with the rotation of the shaft (7) above a limit speed so as to no longer have any mechanical contact with the rear radial bearing (22).

7. The machining method according to claim 1, wherein the workpiece is the air or gas axial bearing (24) in the form of a disc, wherein the ribs or grooves (24*a*) and the arrangement thereof are programmed in the machining unit (100) to activate the machining tool (120) so as to produce all of the ribs or grooves at once on a first face of the disc by moving the machining tool, or a rotating disc in a single machining direction from a periphery of the disc to a bottom of an annular area of the ribs or grooves or conversely, and by the reciprocating motions of the machining tool (120) according to how the machining unit (100) was programmed.

8. The machining method according to claim 7, wherein all of the ribs or grooves (24*a*) are produced at once on a second face of the disc by moving the machining tool, or the rotating disc in a single machining direction from the periphery of the disc to the bottom of the annular area of the ribs or grooves (24*a*) or conversely, and by the reciprocating motions of the machining tool (120) according to how the machining unit (100) was programmed.

9. The machining method according to claim 8, wherein all of the ribs or grooves (24*a*) are produced in the form of spirals with the same orientation on two faces or with two different orientations so as to generate films of air via the grooves when rotating the shaft to hold an axis in a position that is longitudinally well centred during operation of the centrifugal compressor (1).

10. The machining method according to claim 9, wherein all of the ribs or grooves (24*a*) on one face or the two faces of the disc are machined before or after the machining of the ribs or grooves on the first portion and/or the second portion of the shaft (7).

* * * * *